US008893676B2

(12) United States Patent
Hoppe et al.

(10) Patent No.: US 8,893,676 B2
(45) Date of Patent: Nov. 25, 2014

(54) CENTRAL VALVE OF A CAMSHAFT ADJUSTER OF AN INTERNAL COMBUSTION ENGINE

(75) Inventors: Jens Hoppe, Erlangen (DE); Ali Bayrakdar, Roethenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 169 days.

(21) Appl. No.: 13/381,185

(22) PCT Filed: Jun. 4, 2010

(86) PCT No.: PCT/EP2010/057819

§ 371 (c)(1),
(2), (4) Date: Dec. 28, 2011

(87) PCT Pub. No.: WO2011/003682

PCT Pub. Date: Jan. 13, 2011

(65) Prior Publication Data

US 2012/0111296 A1 May 10, 2012

(30) Foreign Application Priority Data

Jul. 4, 2009 (DE) ..... 10 2009 031 701

(51) Int. Cl.

| | |
|---|---|
| ***F01L 1/34*** | (2006.01) |
| ***F01L 1/344*** | (2006.01) |
| *F01L 1/047* | (2006.01) |

(52) U.S. Cl.

CPC ..... *F01L 1/344* (2013.01); *F01L 1/3442* (2013.01); *F01L 2001/34426* (2013.01); *F01L 2001/0475* (2013.01); *F01L 2001/34433* (2013.01)

USPC ..... 123/90.17; 137/625.68

(58) Field of Classification Search

USPC ..... 123/90.12, 90.15, 90.17, 90.33, 90.34; 464/160, 161; 137/625.25, 625.26; 251/368; 29/888.1

See application file for complete search history.

(56) References Cited

U.S. PATENT DOCUMENTS

| | | | | |
|---|---|---|---|---|
| 6,182,622 | B1 * | 2/2001 | Goloyatai-Schmidt et al. | 123/90.15 |
| 6,382,148 | B1 * | 5/2002 | Maeyama et al. | 123/90.15 |
| 7,013,854 | B1 | 3/2006 | Heintzen et al. | |
| 7,025,023 | B2 * | 4/2006 | Lehmann et al. | 123/90.17 |
| 7,243,680 | B2 * | 7/2007 | Golovatai-Schmidt et al. | 137/596.17 |
| 2007/0056540 | A1 * | 3/2007 | Hoppe et al. | 123/90.17 |

FOREIGN PATENT DOCUMENTS

DE 10 2004 038 160 A1 12/2005

* cited by examiner

*Primary Examiner* — Thomas Denion
*Assistant Examiner* — Daniel Bernstein
(74) *Attorney, Agent, or Firm* — Davidson, Davidson & Kappel, LLC

(57) ABSTRACT

A central valve of a camshaft adjuster of an internal combustion engine, which has a valve housing, a control piston, and a mounting flange. The valve housing is arranged, at least in part, inside a receptacle inside the camshaft adjuster. The valve housing has at least one inflow connection, one outflow connection, and one working connection. The control piston is arranged axially slidable inside the valve housing. The pressure fluid, which flows to and from the camshaft adjuster, can be controlled by the suitable positioning of the control piston inside the valve housing. Also, the mounting flange is fixedly connected to a wall section of the receptacle, thus determining the axial position of the valve housing relative to the camshaft adjuster.

13 Claims, 2 Drawing Sheets

CENTRAL VALVE OF A CAMSHAFT ADJUSTER OF AN INTERNAL COMBUSTION ENGINE

CROSS-REFERENCE TO RELATED APPLICATIONS

This application is a 371 of PCT/EP2010/057819 filed Jun. 4, 2010, which in turn claims the priority of DE 10 2009 031 701.5 filed Jul. 4, 2009. The priority of both applications is hereby claimed and both applications are incorporated by reference herein.

FIELD OF THE INVENTION

The invention relates to a central valve of a camshaft adjuster of an internal combustion engine, with a valve housing, a control piston and a fastening flange.

BACKGROUND OF THE INVENTION

In modern internal combustion engines, camshaft adjusters are used in order to be able to variably configure the phase relationship between the crankshaft and camshaft in a defined angle range, between a maximum early position and a maximum late position. For this purpose, the camshaft adjuster is integrated into a drive train via which torque is transmitted to the camshaft by the crankshaft. Said drive train may be realized, for example, as a belt drive, chain drive or gearwheel drive. Camshaft adjusters of this type are generally designed as hydraulic oscillating motors, for example of vane cell design, with at least two pressure chambers acting in an opposed manner. In this case, the supply of pressure medium to or the removal of pressure medium from the pressure chambers is controlled by means of a hydraulic directional control valve, for example a proportional valve. Embodiments are known in this connection, in which the hydraulic directional control valve is arranged in a central passage opening of the camshaft adjuster and rotates together therewith. Directional control valves of this type are customarily referred to as central valves.

A central valve of this type is known, for example, from DE 10 2004 038 160 A1. In this embodiment, a hollow camshaft reaches through a central passage opening of the camshaft adjuster. Within the camshaft, the central valve is arranged in the region of the camshaft adjuster. The central valve consists of a valve housing, a control piston, a spring element and a snap ring. The valve housing, which is of substantially hollow-cylindrical design, has an inlet connection, an outlet connection and two working connections on the outer circumferential surface thereof. Furthermore, an axial outlet connection is provided. The inlet connection communicates with a pressure medium pump of the internal combustion engine, the outlet connections communicate with a pressure medium reservoir, and the working connections each communicate with a group of pressure chambers of the camshaft adjuster. The control piston is arranged in an axially displaceable manner within the valve housing. In this case, the control piston is displaced into any position between two end stops and held there by means of an electromagnetic adjusting unit counter to the force of the spring element supported on the control piston and the valve housing. The first end stop is realized by the snap ring which is arranged at the open end of the valve housing. The second end stop is realized by the spring receptacle.

Depending on the position of the control piston relative to the valve housing, the volumetric flow of pressure medium fed by the pressure medium pump to the inlet connection is conducted to the first or second working connection and therefore to the first or the second pressure chambers. At the same time, the pressure medium is ejected from the other pressure chambers via the other working connection and one of the outlet connections into the pressure medium reservoir.

In addition to the hydraulic connections, the valve housing has a fastening section, a threaded section in the embodiment illustrated, by means of which the central valve is fixed within the camshaft. Furthermore, a collar which extends in the radial direction, protrudes over the camshaft in the radial direction and bears in the axial direction against a cylinder head of the internal combustion engine is formed on that section of the valve housing which projects out of the camshaft. The collar therefore constitutes part of the axial bearing of the camshaft relative to the cylinder head.

Via the axial bearing and the fastening section, a high amount of force is admitted to the valve housing which has to be of appropriately stable design. The entire valve housing is customarily produced from a metal blank by means of machining production processes. This production process is very time-consuming and involves high use of material.

SUMMARY OF THE INVENTION

The invention is based on the object of providing a central valve of a camshaft adjuster of an internal combustion engine, wherein the outlay on production of said central valve is intended to be reduced.

The object is achieved according to the invention in that the fastening flange and the valve housing are formed as two separate components.

The central valve according to the invention has at least a valve housing, a control piston and a fastening flange. The valve housing is at least partially arranged within a receptacle within the camshaft adjuster, for example within a central passage opening of the camshaft adjuster. The valve housing, which may be, for example, of substantially hollow-cylindrical design, has at least one inlet connection, one outlet connection and one working connection. The valve housing interacts with the wall of the receptacle such that the connections are hydraulically separated from one another outside the valve housing. This can be achieved by the valve housing bearing directly against the wall or by interposition of an additional sleeve, the outer circumferential surface of which bears against the wall of the receptacle and the inner circumferential surface of which bears against the outer circumferential surface of the valve housing.

The receptacle is located in the region over which the camshaft adjuster engages, and can be formed directly on the camshaft adjuster or on an intermediate component arranged between the camshaft adjuster and the valve housing. For example, a camshaft can reached through the camshaft adjuster, the camshaft having, in the region of the camshaft adjuster, a receptacle in which the valve housing is arranged.

The control piston is accommodated in an axially displaceable manner within the valve housing. The former can be positioned, for example by means of an electromagnetic adjusting unit, between two end positions. Depending on the position of the control piston relative to the valve housing, pressure medium supplied to the central valve is conducted either to the first or to the second pressure chambers of the camshaft adjuster, with pressure medium being conducted at the same time out of the other pressure chambers to a pressure medium reservoir.

The axial position of the valve housing within the receptacle is defined by means of the fastening flange which is connected to a wall of the receptacle in a rotationally fixed manner and such that it is not displaceable in the axial direction. The fastening flange can be connected fixedly to the wall of the receptacle in a form-fitting, adhesively bonded or frictional manner, for example by means of a welded, soldered, adhesive or screw connection, by means of a press fit or calking.

By means of the separate formation of the fastening flange, that region of the central valve which is loaded during the operation of the internal combustion engine is separated from the valve housing which is otherwise unloaded and serves merely to control the streams of pressure medium to and from the camshaft adjuster. Only the loaded fastening flange therefore has to be of solid design while the valve housing can be produced by means of cost-effective and quick processes. For example, valve housings which are formed as a sheet-metal component and are produced, for example, by means of a nonmachining forming process, for example a deep-drawing process, are conceivable.

The separation of the fastening flange from the valve housing reduces the complexity of the solid fastening flange, and therefore the latter can be produced by means of simpler manufacturing processes than the valve housing known from the prior art. For example, extrusion processes or the like are conceivable. The production of the central valve, in particular of the valve housing and of the fastening component, is therefore considerably simplified and the production costs thereof reduced. Furthermore, the use of material is reduced.

In a physical embodiment of the invention, provision is made for the valve housing to be connected to the fastening flange in a form-fitting, adhesively bonded or frictional manner. The valve housing can be connected to the fastening flange, for example, by means of a welding, soldering, adhesive bonding or screw connection, by means of a press fit or a calking. A subassembly can therefore be premanufactured, which can be installed as a whole.

As an alternative, the valve housing can bear on the one hand against a stop of the receptacle and on the other hand against the fastening flange. In this embodiment, the valve housing is first of all placed into the receptacle and then the fastening flange is connected fixedly to the wall of the receptacle. In the process, the valve housing is pressed by means of the fastening flange against the receptacle, and therefore the axial position of the valve housing within the receptacle is fixed.

In a development of the invention, provision can be made for the fastening flange to have a collar which is arranged outside the camshaft adjuster and in at least one axial direction bears against a cylinder-head-mounted component of the internal combustion engine. The cylinder-head-mounted component may be, for example, the cylinder head, the cylinder head cover or a component connected fixedly to the cylinder head. Therefore, the axial bearing function of the camshaft or of the camshaft adjuster can be integrated into the central valve according to the invention.

The valve housing can advantageously be designed as a substantially tubular sheet-metal component. The sheet-metal component can come to bear directly against the wall of the receptacle, and therefore the hydraulic connections of the valve housing are hydraulically separated from one another outside the valve housing. As an alternative, the tubular sheet-metal component can be surrounded by an adapter sleeve, for example a plastics sleeve, the outer circumferential surface of which bears against a wall of the receptacle. The valve housing is therefore formed by the tubular component and the adapter sleeve. The adapter sleeve can be connected fixedly to the fastening flange or to the tubular sheet-metal component or to both. This can be realized, for example, by means of an adhesive bonding connection, a clip connection or a crimped connection. In the case of a plastics sleeve, the latter can be sprayed directly onto the tubular component. In this case, the tubular sheet-metal component serves as a bearing and sliding surface for the control piston. The tubular component can be designed with a small wall thickness, and the distance from the wall of the receptacle can be bridged by means of a lightweight plastics sleeve. As a result, the weight of the valve housing rotating with the camshaft adjuster is reduced. Furthermore, the small wall thickness of the tubular component makes the production of said component easier. The adapter sleeve can be connected fixedly to the fastening flange or to the tubular sheet-metal component or to both.

In addition, a filter fabric can be arranged between the tubular sheet-metal component and the adapter sleeve in the region of at least one of the connections. The penetration of protective particles into the central valve is therefore prevented, thus preventing jamming of the control piston and reducing wear. Furthermore, the filter fabric is accommodated captively and a fixed position in the valve housing of the central valve.

In a development of the invention, it is proposed that an end stop on the fastening flange and/or the valve housing is designed for the control piston. Owing to the lower complexity of the fastening flange and of the valve housing, it is possible, during the production processes thereof, to form the end stops without an additional outlay. Additional components which carry out this function are therefore not required.

In a development of the invention, provision is made for a spring receptacle for a spring element, which is supported on the control piston and the spring receptacle, to be formed on the valve housing. The spring receptacle is formed on the valve housing, for example the tubular sheet-metal component or the adapter sleeve. No additional component is thus needed for this functionality either.

BRIEF DESCRIPTION OF THE DRAWINGS

Further features of the invention emerge from the description below and from the drawings in which an exemplary embodiment of the invention is illustrated in simplified form and in which.

DETAILED DESCRIPTION OF THE INVENTION

Figure 1:
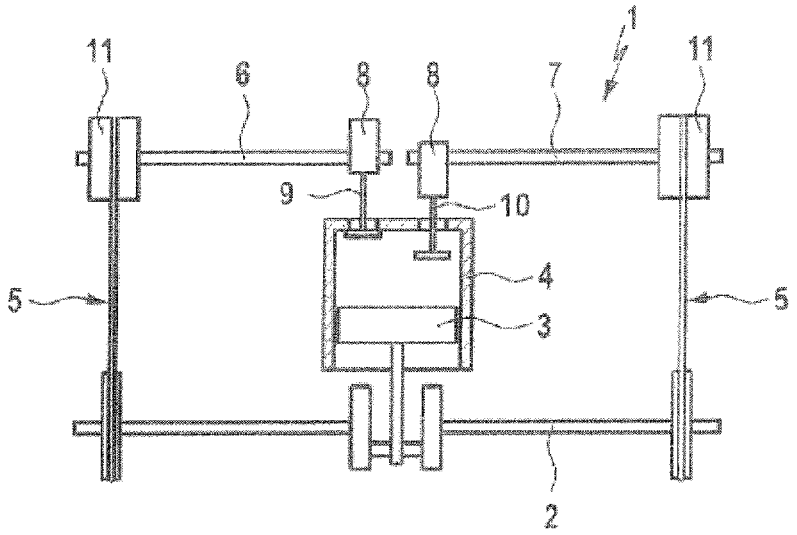
FIG. 1 shows an internal combustion engine merely highly schematically.

FIG. 1 is a sketch of an internal combustion engine in which a piston 3 sitting on a crankshaft 2 is indicated in a cylinder 4. In the embodiment illustrated, the crankshaft 2 is connected to an inlet camshaft 6 and an outlet camshaft 7 via a respective traction mechanism drive 5, wherein a first and a second camshaft adjuster 11 can ensure a relative rotation between the crankshaft 2 and the camshafts 6, 7. Cams 8 of the camshafts 6, 7 actuate one or more inlet gas exchange valves 9 and one or more outlet gas exchange valves 10. Provision may also be made for only one of the camshafts 6, 7 to be equipped with a camshaft adjuster 11 or for there only to be one camshaft 6, 7 which is provided with a camshaft adjuster 11.

Figure 4:
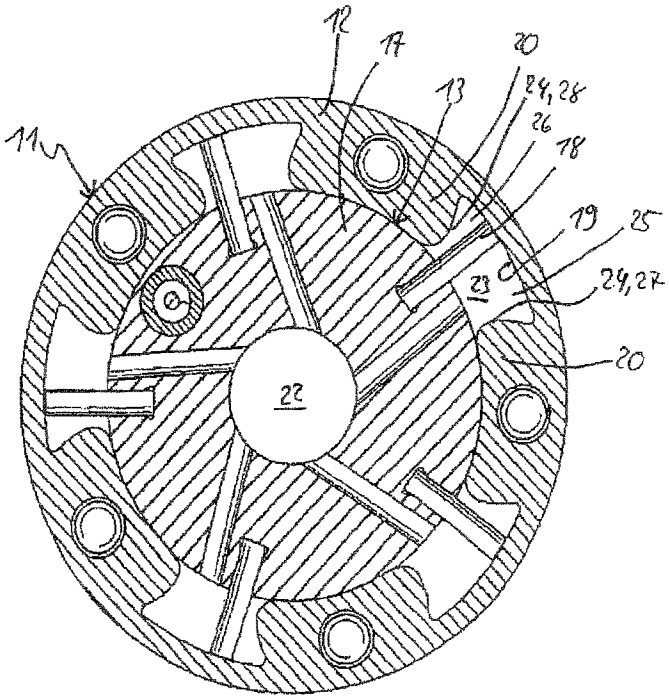
Prior art Fig. 4
FIG. 4 shows a cross section through the device from FIG. 3 along the line IV-IV.
Figure 3:
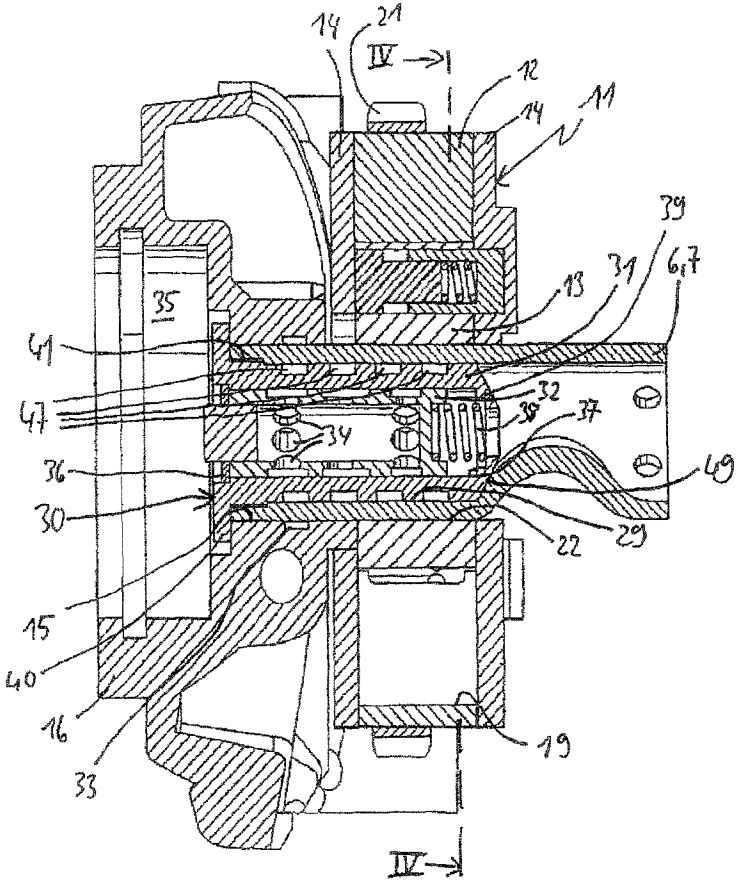
Prior art Fig. 3
FIG. 3 shows a longitudinal section through a camshaft adjuster fastened to a camshaft and having a central valve according to the prior art.

FIG. 3 shows, in longitudinal section, a camshaft adjuster 11 fastened to a camshaft 6, 7, as disclosed in DE 10 2004 038 160 A1. FIG. 4 shows a cross section through the camshaft adjuster 11 along the line IV-IV in FIG. 3. The camshaft adjuster 11 has a driving element 12 and a driven element 13. A respective side cover 14 is arranged on the axial side surfaces of the driving element 12. The side covers 14 are connected in a rotationally fixed manner to the driving element 12. Five projections 20 extend radially inward from a circumferential wall 19 of the driving element 12. In the embodiment illustrated, the projections 20 are formed as a single part with the circumferential wall 19. By means of radially inner circumferential walls of the projections 20 relative to the driven element. 13, the driving element 12 is arranged rotatably with respect to the latter.

The driven element 13 is in the form of an impeller and has a hub element 17 which is of substantially cylindrical design and from the outer, cylindrical circumferential surface of which, in the embodiment illustrated, five vanes 18 extend outward in the radial direction. The vanes 18 are formed separately from the driven element 13 and are arranged in vane grooves in the outer circumferential surface of the hub element 17.

Torque can be transmitted by the crankshaft 2 to the driving element 12 by means of a chain drive (not illustrated) via a chain wheel 21 which is connected in a rotationally fixed manner to the driving element 12. The camshaft 6, 7 reaches through a central passage opening 22 of the driven element 13, said camshaft being connected to the driven element 13 in a frictional manner. In the embodiment illustrated, the camshaft 6, 7 is designed as a hollow shaft and is mounted rotatably within a camshaft radial bearing 15 of a cylinder head 16.

Within the camshaft adjuster 11, a pressure space 23 is formed between every two adjacent projections 20 in the circumferential direction. Each of the pressure spaces 23 is bounded in the circumferential direction by opposite, substantially radially extending boundary walls 24 of adjacent projections 20, in the axial direction by the side covers 14, radially inward by the hub element 17 and radially outward by the circumferential wall 19. A vane 18 projects into each of the pressure spaces 23, wherein the vanes 18 are designed in such a manner that they bear both against the side covers 14 and against the circumferential wall 19. Each vane 18 therefore divides the particular pressure space 23 into two pressure chambers 25, 26 acting in an opposed manner.

The driven element 13 is arranged rotatably in a defined angle range with respect to the driving element 12. The angle range is bounded in one direction of rotation of the driven element 13 by the vanes 18 coming to bear in each case against a corresponding boundary wall 24 (early stop 27) of the pressure spaces 23. The angle range in the other direction of rotation is analogously bounded by the vanes 18 coming to bear against the other boundary walls 24 of the pressure spaces 23, which boundary walls serve as a late stop 28.

The phase position of the driving element 12 with respect to the driven element 13 (and therefore the phase position of the camshaft 6, 7 with respect to the crankshaft 2) can be varied by pressurization of one group of pressure chambers 25, 26 and pressure relief of the other group. The phase position can be kept constant by pressurization of both groups of pressure chambers 25, 26.

A central valve 30 is arranged in a receptacle 29 of the camshaft 6, 7. The central valve 30 has a valve housing 31 and a control piston 32. The valve housing 31 is of substantially hollow-cylindrical design, wherein an inlet connection P, an outlet connection T and two working connections A, B in the form of annular grooves 47 communicating with the interior of the valve housing 31 by means of a radial openings 48 are formed on the cylindrical circumferential surface of said valve housing. Furthermore, an axial outlet connection T, in the form of an axial opening, is provided.

The inlet connection P communicates with a pressure medium pump (not illustrated) via a pressure medium channel 33 formed in the cylinder head 16. The outlet connections T communicate with a pressure medium reservoir (likewise not illustrated). The first working connection A communicates with the first pressure chambers 25, and the second working connection B communicates with the second pressure chambers 26.

During the operation of the internal combustion engine 1, pressure medium passes via the inlet connection P into the interior of the valve housing 31 and via piston openings 34 into the interior of the control piston 32. Depending on the position of the control piston 32 relative to the valve housing 31, the pressure medium passes to the first or second working connection A, B and therefore to the respective pressure chambers 25, 26. At the same time, pressure medium is conducted from the other pressure chambers 25, 26 via the other working connections A, B and the respective outlet connection T to the pressure medium reservoir.

The axial position of the control piston 32 can be set as desired between two end stops 36, 37 by means of an electromagnetic adjusting unit 35. The first end stop 36 is realized by means of a snap ring which is arranged on the open side of the valve housing 31. In this case, the control piston 32 is acted upon on one side by a push rod (not illustrated) of the adjusting unit 35 and on the other side by a spring element 39 which is supported on a spring receptacle 39 of the valve housing 31, which spring receptacle at the same time forms the second end stop 37.

The valve housing 31 is fastened in a rotationally fixed and nondisplaceable manner in the camshaft 6, 7. For this purpose, a threaded section 41 is formed on the valve housing 31 and is used to screw the latter to the camshaft 6, 7. The valve housing 31, at the end thereof which protrudes out of the camshaft 6, 7, has a collar 40 extending in the radial direction. The collar 40 bears in the axial direction against the cylinder head 16 such that an axial movement of the camshaft 6, 7 to the right in FIG. 3 is prevented. Furthermore, the drive element 13 likewise bears against the cylinder head 16 such that an axial movement of the camshaft 6, 7 to the left in FIG. 3 is prevented. The collar 40 therefore forms part of the axial bearing of the camshaft 6, 7 in the cylinder head 16.

In this embodiment which is known from the prior art, the valve housing 31 takes over the function of distributing pressure medium to the pressure chambers 25, 26 and the axial bearing of the camshaft 6, 7. Furthermore, the fastening of the central valve 30 within the receptacle 29 is likewise carried out via the valve housing 31. The valve housing 31 has to be formed with increased strength because of the axial bearing and fastening function. The valve housing 31 is customarily produced from a solid metal blank by machining, for example by turning. During the production of the valve housing 31, a large amount of material has to be removed from the blank because of the collar 40 and the threaded section 41, thus resulting in high material costs and in the cycle times being low.

Figure 2:
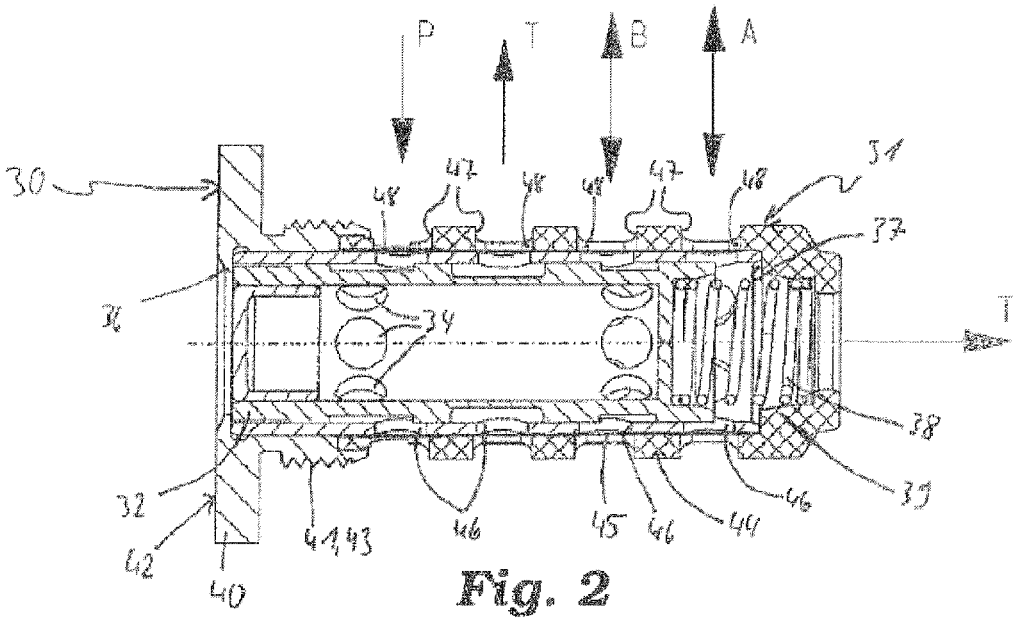
FIG. 2 shows a longitudinal section through a central valve according to the invention.

FIG. 2 shows by way of example an embodiment of a central valve 30 according to the invention which does not have these disadvantages. In contrast to the central valve 30 known from the prior art, the axial bearing and fastening functionalities are separated from the valve housing 31 and integrated into a fastening flange 42. Therefore, only the fastening flange 42 has to be of high strength and formed, for example as a turned component. Metal injection-molded parts, sintered parts, deep drawn parts or extruded parts which are finished by machining are likewise conceivable, for example. The fastening flange 42 has the collar 40 required for the axial bearing of the camshaft 6, 7 and a fastening section 43. The fixed connection between the camshaft 6, 7 and the central valve 30 is produced by means of the fastening section 43. In the embodiment illustrated, a threaded section 41 is formed on the fastening section 43. Form-fitting elements or a surface, by means of which a press fit to the camshaft 6, 7 can be realized, are likewise conceivable.

Since, in this embodiment, no high loads act on the valve housing 31, the latter can be designed as a cost-effective sheet-metal component, for example as a deep-drawn component. The material use and the production time for producing the central valve 30 are therefore reduced. In the embodiment illustrated, the valve housing 31 is designed as a tubular sheet-metal part, the cylindrical circumferential surface of which has four groups of housing openings 46 via which pressure medium can be interchanged between the interior and the exterior of the tubular sheet-metal component. The housing openings 46 of a group are formed on the tubular component in a manner spaced apart in the circumferential direction from one another. The groups are offset axially with respect to one another. Each group of housing openings 46 forms one of the radial pressure medium connections A, B, P, T.

In the embodiment illustrated, the valve housing 31 is inserted into the fastening flange 42 and is connected to the latter in a frictional manner, by means of a press fit. As an alternative or in addition, form-fitting or adhesive bonding connecting methods, for example screw connections, calking, welding, soldering or adhesive bonding connections, are likewise conceivable.

On the outer circumferential surface of the tubular sheet-metal component, the valve housing 31 has an adapter sleeve 44 which, in the fitted state of the central valve 30, bears against the wall of the receptacle 29 in a pressure-medium-tight manner. In the embodiment illustrated, the adapter sleeve 44 is designed as a plastics sleeve and is fixedly connected both to the valve housing 31 and to the fastening flange 42. The adapter sleeve 44 may be, for example, sprayed directly onto the valve housing 31 or manufactured separately and fastened to the valve housing 31 by means of an adhesive bonding connection. The connection to the fastening flange 42 is realized by means of crimping in the region of the threaded section 41 of the fastening flange 42. Latching or clip connections are likewise conceivable.

Four annular grooves 47 which are offset axially with respect to one another are formed on the outer circumferential surface of the adapter sleeve 44 and openings 48 are provided in the groove bases of said annular grooves. The openings 48 are aligned with the housing openings 46 such that pressure medium can be interchanged between the interior and the exterior of the valve housing 31.

A filter element 45 in the form of a filter fabric is provided between the adapter sleeve 44 and the valve housing 31, which filter element extends in the axial direction along the radial working connections A, B, P, T and prevents dirt particles from entering the valve housing 31.

The control piston 32 and the spring element 38 are arranged within the valve housing 31. The control piston 32 is arranged in an axially displaceable manner between the first end stop 36, which is formed on the fastening flange 42 and the second end stop 37, which is formed by the spring receptacle 39. The spring element 38 is supported on one side on the spring bearing 39 and on the other side on the control piston 32.

During the production of the central valve 30, first of all the tubular component is connected fixedly to the fastening flange 42 and the control piston 32 and the spring element 38 are positioned within the valve housing 31. The valve housing 31 is subsequently completed by the adapter sleeve 44 being sprayed onto the tubular component or by a separately manufactured adapter sleeve 44 being fastened to the tubular component and/or to the fastening flange 42. To install the central valve 30 in the receptacle 29, said central valve is screwed by means of the threaded section 41 into the camshaft 6, 7. The valve housing 31 comes into contact in the process with a stop 49 (FIG. 3) which is formed in the camshaft 6, 7.

Embodiments in which the adapter sleeve 44 is dispensed with and the tubular component bears directly against the wall of the receptacle 29 are likewise conceivable.

Furthermore, embodiments in which the central valve 30 is directly connected to the central passage opening 22 of the driven element 13 by means of the fastening section 43, are also conceivable. In this case, the camshaft 6, 7 reaches at least not completely through the central passage opening 22, and the fastening section 43 bears directly against the wall of the central passage opening 22, which wall serves in this case as the receptacle 29.

DESIGNATIONS

1 Internal Combustion Engine
2 Crankshaft
3 Piston
4 Cylinder
5 Traction Mechanism Drive
6 Inlet Camshaft
7 Outlet Camshaft
8 Cam
9 Inlet Gas Exchange Valve
10 Outlet Gas Exchange Valve
11 Camshaft Adjuster
12 Driving Element
13 Driven Element
14 Side Cover
15 Camshaft Radial Bearing
16 Cylinder Head
17 Hub Element
18 Vane
19 Circumferential Wall
20 Projection
21 Chain Wheel
22 Central Passage Opening
23 Pressure Space
24 Boundary Wall
25 First Pressure Chamber
26 Second Pressure Chamber
27 Early Stop
28 Late Stop
29 Receptacle
30 Central Valve
31 Valve Housing
32 Control Piston
33 Pressure Medium Channel
34 Piston Opening
35 Adjusting Unit
36 End Stop
37 End Stop

38 Spring Element
39 Spring Receptacle
40 Collar
41 Threaded Section
42 Fastening Flange
43 Fastening Section
44 Adapter Sleeve
45 Filter Element
46 Housing Opening
47 Annular Groove
48 Opening
49 Stop
A First Working Connection
B Second Working Connection
P Inlet Connection
T Outlet Connection

The invention claimed is:

1. A central valve of a camshaft adjuster of an internal combustion engine, comprising:

a valve housing at least partially arranged within a receptacle, which has a wall and is arranged within the camshaft adjuster, the valve housing having at least one inlet connection, one outlet connection and one working connection;

a control piston arranged in an axially displaceable manner within the valve housing so that streams of pressure medium to and from the camshaft adjuster can be controlled by positioning the control piston within the valve housing; and a fastening flange, which defines an axial position of the valve housing relative to the camshaft adjuster, fixedly connected to the wall of the receptacle, wherein the fastening flange includes a cylindrical portion with a cylindrical bore and having a first axial end, a second axial end, a collar disposed at the first axial end and an end stop for the control piston disposed at the first axial end, and the valve housing is a separate cylindrical element received in the cylindrical bore.

2. The central valve according to claim 1, wherein the valve housing is connected to the fastening flange in a form-fitting, adhesively bonded or frictional manner.

3. The central valve according to claim 1, wherein the receptacle has a stop, and the valve housing bears against the stop of the receptacle and against the fastening flange.

4. The central valve according to claim 1, wherein the collar is arranged outside the camshaft adjuster so that the collar in at least one axial direction hears against a cylinder-head-mounted component of the internal combustion engine.

5. The central valve according to claim 1, wherein the valve housing is a substantially tubular sheet-metal component.

6. The central valve according to claim 5, wherein the tubular sheet-metal component has an adapter sleeve which surrounds the tubular sheet-metal component and an outer circumferential surface of the adaptor sleeve bears against the wall of the receptacle.

7. The central valve according to claim 6, wherein the adapter sleeve is fixedly connected to the fastening flange or to the tubular sheet-metal component.

8. The central valve according to claim 6, further comprising a filter fabric arranged between the tubular sheet-metal component and the adapter sleeve in a region of at least one of the connections.

9. The central valve according to claim 1, wherein the valve housing has an end stop for the control piston.

10. The central valve according to claim 1, wherein the valve housing has a spring receptacle and a spring element is arranged in spring receptacle, the spring element being supported on the control piston and on the spring receptacle.

11. The central valve according to claim 1, wherein an axial end of the valve housing abuts the end stop.

12. The central valve according to claim 11, wherein the axial end of the valve housing that abuts the end stop is arranged axially between axial ends of the collar.

13. The central valve according to claim 11, further comprising an adapter sleeve that surrounds the valve housing and an outer circumferential surface of the adaptor sleeve bears against the wall of the receptacle, the second axial end of the cylindrical portion defining a groove having a greater diameter than a diameter of the cylindrical bore, an end of the adaptor sleeve being received in the groove.

* * * * *